United States Patent [19]

Frolov et al.

[11] Patent Number: 4,665,583

[45] Date of Patent: May 19, 1987

[54] DOOR CLOSER PISTON ASSEMBLY HAVING SEPARATE HEAD PORTIONS

[75] Inventors: Georgy Frolov, Farmington; Walter E. Surko, Jr., Southington, both of Conn.

[73] Assignee: Emhart Industries, Inc., Farmington, Conn.

[21] Appl. No.: 846,844

[22] Filed: Apr. 1, 1986

Related U.S. Application Data

[63] Continuation of Ser. No. 655,874, Sep. 28, 1984, abandoned.

[51] Int. Cl.[4] ..... E05F 3/10

[52] U.S. Cl. ..... 16/52; 16/58; 16/62; 16/79; 91/405; 92/136; 92/255

[58] Field of Search ..... 16/52, 58, 62, 64, 69, 16/79; 92/136, 255; 91/405

[56] References Cited

U.S. PATENT DOCUMENTS 3,000,043 9/1961 Check ..... 16/64
3,220,047 11/1965 Flint ..... 16/62
3,323,422 6/1967 Freese ..... 91/405
3,408,683 11/1968 Zahn ..... 16/52 X

FOREIGN PATENT DOCUMENTS 2051331 4/1972 Fed. Rep. of Germany ..... 16/62

*Primary Examiner*—Fred Silverberg
*Attorney, Agent, or Firm*—Barry E. Deutsch

[57] ABSTRACT

A hydraulic door closer has a housing including a bore and a piston supported for reciprocal sliding movement within the bore in door opening and closing directions corresponding, respectively, to opening and closing movements of an associated door. The piston has a head at one end and an open opposite end which receives a portion of a spring which biases the piston in its door closing direction. First and check second check valves within the head comprise part of a fluid control system for checking movement of the piston during at least a portion of its travel in either its door opening or door closing direction.

16 Claims, 11 Drawing Figures

DOOR CLOSER PISTON ASSEMBLY HAVING SEPARATE HEAD PORTIONS

This is a continuation of co-pending application Ser. No. 655,874 filed on Sept. 28, 1984, now abandoned.

BACKGROUND OF THE INVENTION

This invention relates in general to door closers and deals more particularly with an improved hydraulic door closer for controlling both opening and closing movements of a door. A door closer of the type with which the present invention is concerned has at least two check valves to provide alternate fluid flow paths between chambers located at opposite sides of a piston. The piston usually has heads at its opposite ends to accommodate the required valves and a closer spring or springs which store energy when an associated door is opened and provide biasing force for returning the door to closed position. The spring or springs act between one of the piston heads and an associated end of the cylinder or housing in which the piston is contained. This arrangement necessitates a relatively long housing to accommodate the combined length of the piston and the closer spring or springs. Heretofore, door closers have been provided which include a piston having a single head at one end and an opening at its opposite to receive a portion of the biasing spring or springs which drive the piston. However, such closers usually have only one check valve and are not capable of back checking, that is checking or cushioning movement of an associated door during at least a portion of its travel toward fully open position.

Accordingly, it is the general aim of the present invention to provide an improved hydraulic door closer for checking movement of a door during at least a portion of its travel in either direction between open and closed positions. It is a further aim of the invention to provide a compact, durable door closer of the aforedescribed general type for low cost manufacture.

SUMMARY OF THE INVENTION

A door closer has a housing including a cylindrical bore which contains a quantity of working fluid and a piston supported in the bore for reciprocal sliding movement in door opening and closing directions corresponding, respectively, to opening and closing movements of an associated door. The bore and piston cooperate to define first and second chambers of variable volume at opposite sides of the piston. Biasing means urge the piston in its door closing direction. First and second check valves carried by the piston comprise part of a fluid control means for checking movements of the piston during at least a portion of its travel in either direction. A means is provided to move the piston in its opening direction in opposition to biasing force exerted upon the piston by the biasing means. In accordance with the invention the piston has a head proximate one of its ends and the first and second check valves are carried by the head.

DETAILED DESCRIPTION OF PREFERRED EMBODIMENT

Figure 1:
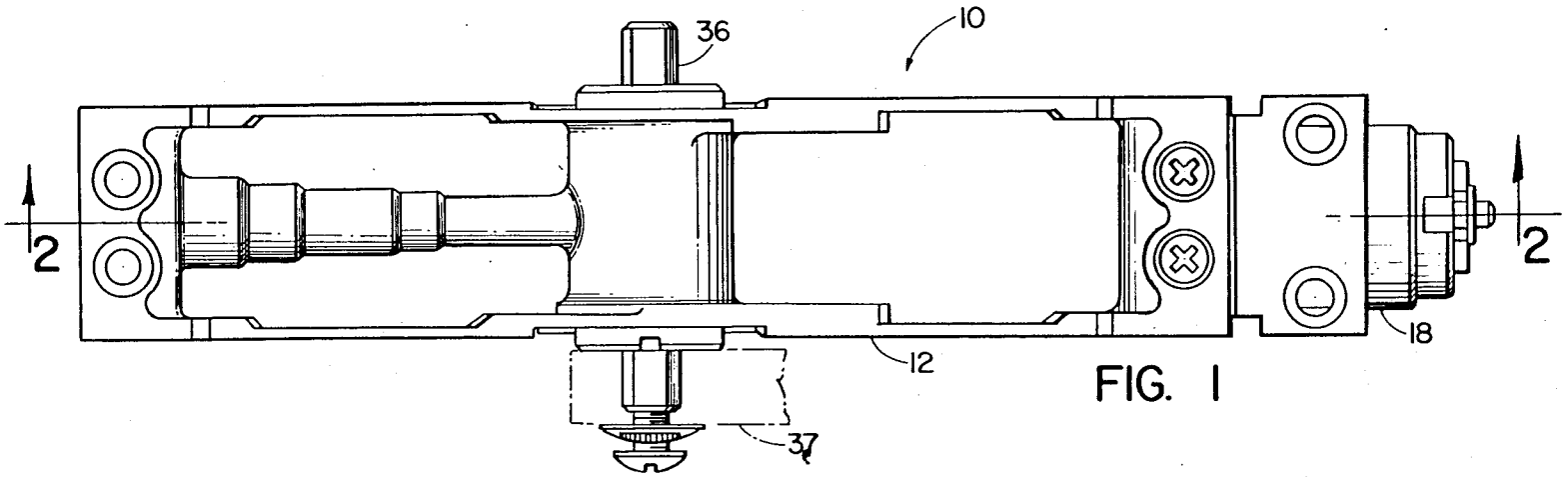
FIG. 1 is a rear elevational view of a door closer embodying the present invention.

Turning now to the drawings, a fluid or hydraulic door closer embodying the present invention is indicated generally by the reference numeral 10. The illustrated door closer 10 is particularly adapted for mounting on a door or its associated frame (not shown), to control both opening and closing movements of the door, and includes a housing or case 12 which has a cylindrical bore 14 containing a quantity of working fluid and sealed at its opposite ends by end caps 16 and 18. A piston assembly, designated generally by the numeral 20, is supported within the bore 14 for reciprocal sliding movement in opening and closing directions, respectively corresponding to opening and closing movements of an associated door. The piston assembly 20 includes an axially elongated generally cylindrical tubular piston body 24 closed at one end by a head assembly, indicated generally at 26 and formed by a plurality of parts. A pair of coaxially arranged compression springs 28 and 30 extend into the open end of the body 24 and act between the head assembly 26 and the right hand end of the case 12, as it appears in the drawings, to bias the piston assembly 20 toward the opposite end of the case and in closing direction.

In accordance with the present invention, first and second check valves, indicated at 32 and 34, respectively, and best shown in FIG. 5, comprise the head assembly 26, and form part of a fluid control system for checking movement of the piston assembly 20 during at least a portion of its travel in either direction within the bore 14, as will be hereinafter more fully discussed.

A spindle 36 journalled in the case 12 has upper and lower end portions which respectively project above and below the case, as shown in FIG. 1. Each end portion has a non-circular cross section to facilitate non-rotatable connection with one end of a conventional closer arm assembly, a portion of which is shown in phantom in FIG. 1 and indicated at 37. The closer arm assembly may comprise a single arm having its other end supported to move along a track or a plurality of articulated arms. The door closer 10 is not handed, that is, it may be mounted to operate a door of either hand without modification, and it is for this reason that the two projecting spindle end portions are provided for selective use. The spindle 36 carries a pinion 38 which engages a rack 40 formed on the piston body 24.

Considering now the piston assembly 20 in further detail the body 24 is preferably formed from welded tubing of uniform wall thickness and has a coaxial bore 42 and finished cylindrical portions 44 and 46 at its opposite ends. The outside diameters of the finished portions 44 and 46 are approximately equal to the diameter of the cylindrical bore 14. However, the tolerance between the rear finished portion 46 and the housing bore 14 is calculated to allow slight fluid leakage therebetween, for a purpose which will be hereinafter more fully explained. An intermediate portion of the piston body, indicated at 48 and located between the finished portions 44 and 46, has a somewhat reduced diameter and provides substantial clearance between the cylindrical bore 14 and intermediate portion 48. The rack 40 is formed on the intermediate portion 48 and extends longitudinally of the piston body. An axially forwardly and radially inwardly inclined groove, 52 is formed in the forward end portion of the piston body, as best shown in FIGS. 5 and 6.

Figure 5:
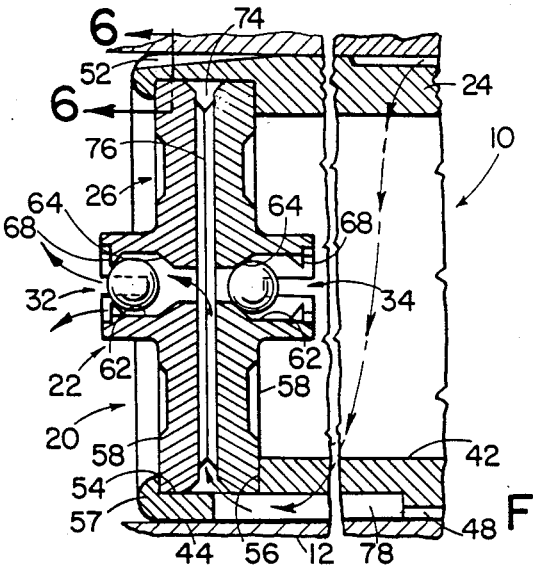
FIG. 5 is a somewhat enlarged fragmentary sectional view of a portion of the door closer.
Figure 6:
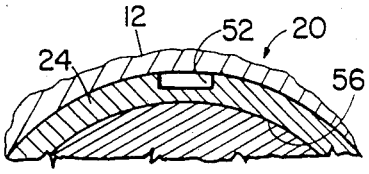
FIG. 6 is a sectional view taken along the line 6—6 of FIG. 5.
Figure 9:
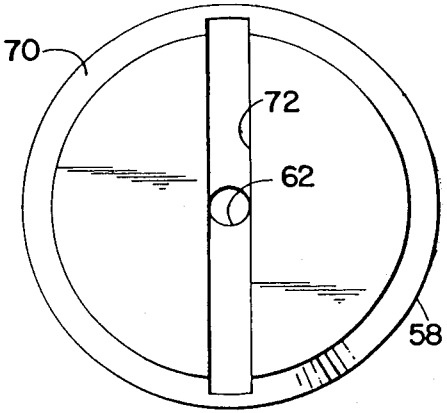
FIG. 9 is a rear elevational view of the half-section shown in FIG. 7.
Figure 8:
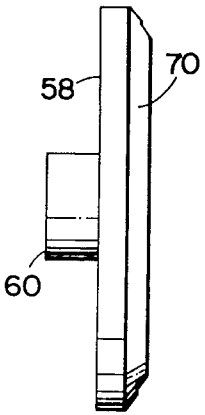
FIG. 8 is a side elevational view of the half-section shown in FIG. 7.

An enlarged coaxial cylindrical bore portion 54 is formed in the forward end of the piston body 24 and defined, in part, by a radially disposed and axially outwardly facing bearing surface 56, as best shown in FIG. 5.

Figure 7:
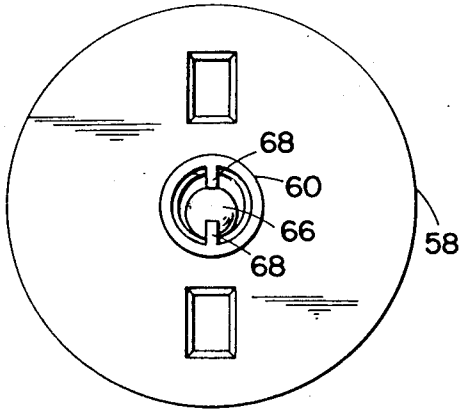
FIG. 7 is a somewhat enlarged front elevational view of a typical half-section of the piston head assembly.
Figure 11:
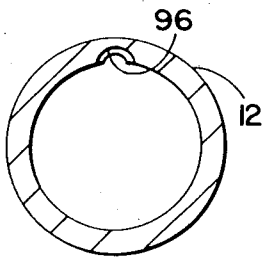
FIG. 11 is a somewhat enlarged fragmentary sectional view taken along the line 11—11 of FIG. 4.
Figure 10:
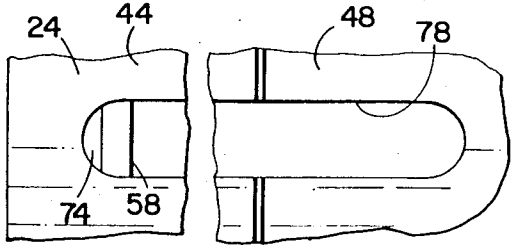
FIG. 10 is a fragmentary bottom view of the piston as shown in FIG. 5.

The head assembly 26 is preferably formed by substantially identical half-sections 58, 58 assembled with the piston body 24 in back-to-back relation to each other, as best shown in FIG. 5. A typical half-section 58, shown in FIGS. 5 and 7–9, comprises a generally cylindrical plate which is preferably formed from powdered metal and has an integral coaxial cylindrical stem portion 60 projecting from its frontal surface. A stepped cylindrical bore 62 extends coaxially through the plate and defines a conical valve seat 64. A spherical ball 66 which has a diameter somewhat smaller than the diameter of the bore 62, is loosely received within the latter bore and retained therein for limited axial movement by staking at 68, 68, substantially as shown in FIGS. 5 and 7. The illustrated half-section 58 has a chamfered rear circular edge 70. A diametrically extending groove 72 opens outwardly through the rear surface of the plate and communicates with the chamfered circular edge 70 and with the bore 62.

The half-sections 58, 58 which comprise the head assembly 26 are positioned in back-to-back relation with the grooves 72, 72 in registry with each other. The head assembly is received within the enlarged bore portion 54 in bearing engagement with the annular bearing surface 56 and is retained in assembly with the piston body 24 by rolling or otherwise deforming the edge of the piston body 24 to radially inwardly displace material indicated at 57 at the forward end of the piston body. In assembly, the chamfered edges 70, 70 cooperate with each other to define an annular groove 74 in the head assembly 26. The grooves 72, 72 cooperate with each other to define a passageway 76 which communicates with the annular groove 74 and with the bores 62, 62, as shown in FIG. 5.

A slot 78 formed in the wall of the closer piston 24 communicates with the intermediate portion and with the annular groove 74 to provide a fluid flow path therebetween.

Figure 3:
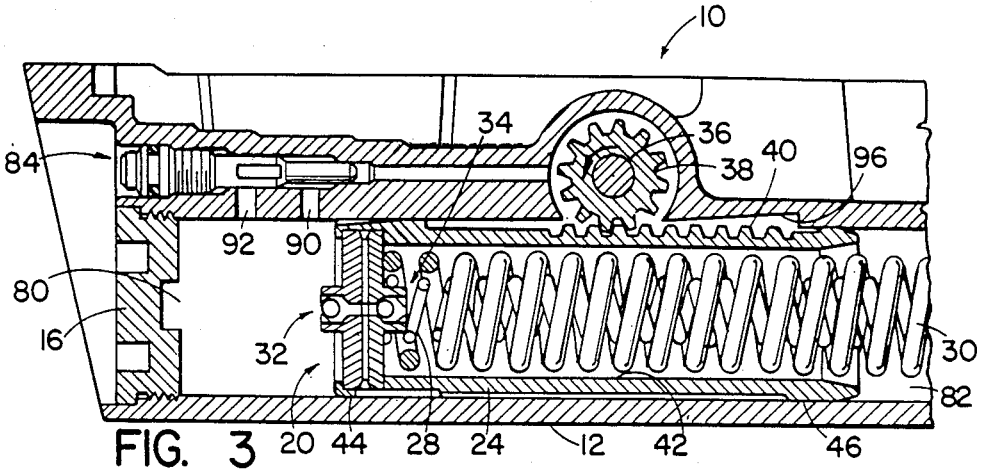
FIG. 3 is a fragmentary sectional view similar to FIG. 2, but shows the closer piston in another position.
Figure 4:
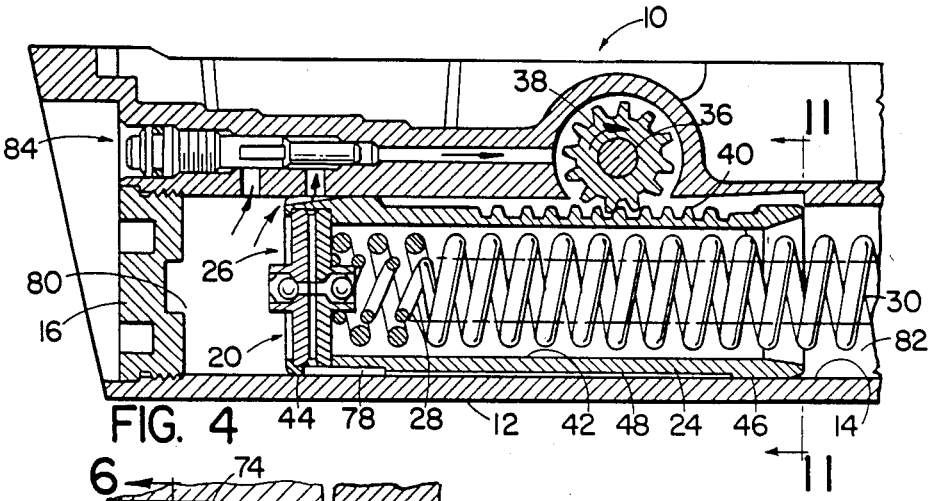
FIG. 4 is similar to FIG. 3, but shows the closer piston in still another position.

Considering now the fluid control system for checking movement of the closer piston, it should be noted that the piston 24 cooperates with the bore 14 to define first and second working chambers of variable volume at opposite sides of the piston indicated, respectively, by the numerals 80 and 82. An adjustable control valve, indicated generally at 84, and threaded into one end of the case 12, extends into a valve chamber 86 which communicates with a fluid passageway 88 and also with the second chamber 82 when the piston is in its position of FIG. 2 which corresponds to the closed position of an associated door. Longitudinally spaced apart valve ports 90 and 92 disposed near the left hand end of the case, as it appears in the drawings, provide fluid communication between the first chamber 80 and the valve chamber 86 when the closer piston 24 is in a position corresponding to an open position of the door, as shown in FIGS. 3 and 4. The groove 52 is maintained in general alignment with the ports 90 and 92 by mating engagement of the pinion 38 with the rack 40, which prevents rotation of the closer piston 24 within the bore 14. A relieved portion of the housing indicated at 96 provides fluid communication between the passageway 88 and the second chamber 82 when the piston is in a position corresponding to the closed position of an associated door and during at least a portion of piston travel toward a fully open position of the door.

Figure 2:
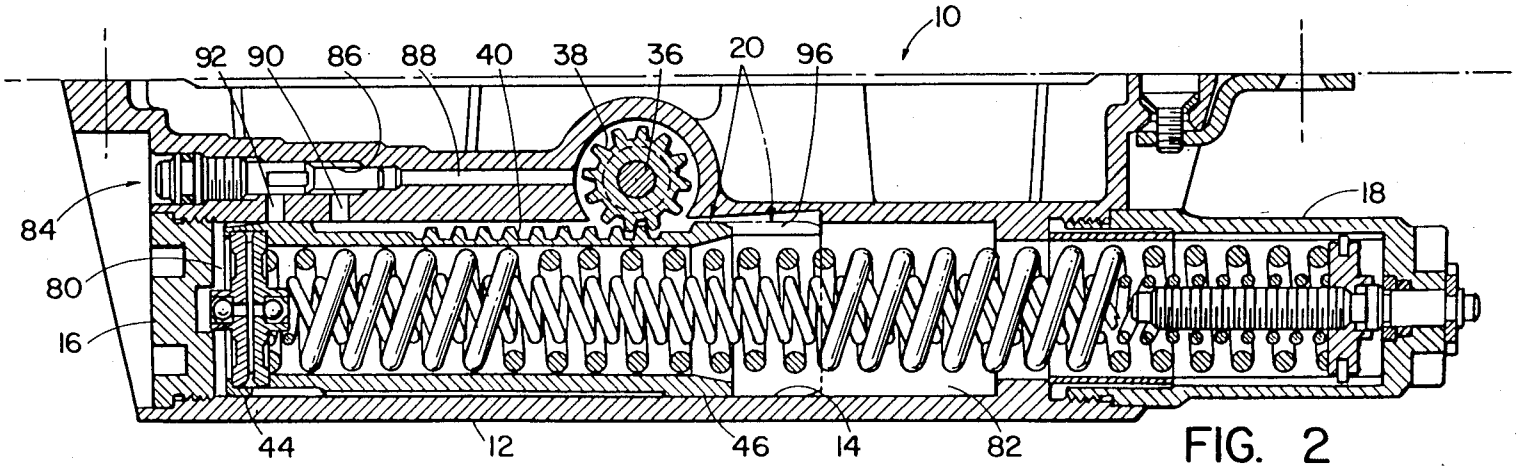
FIG. 2 is a sectional view taken along the line 2—2 of FIG. 1.

When an associated door is closed the piston 24 is in a closed door position as it appears in FIG. 2. Movement of the door toward an open position causes movement of the arm assembly 37, connected between the associated door and the spindle 36, to rotate the spindle in a counterclockwise direction, as viewed from below in FIG. 2, to move the piston assembly 20 toward the right and to an open door position, as it appears in FIG. 3, in opposition to biasing force exerted by the springs 28 and 30. As the piston moves toward the right or in its opening direction, fluid within the second chamber 82 causes the ball check 66 associated with the second check valve 34 to seat on its associated valve seat 64, thereby blocking fluid flow through the second check valve. However, the relieved portion 96 provides a flow path from the second chamber 82 past the finished portion 46 to the intermediate portion 48 allowing working fluid to flow around the piston in the space between the intermediate portion and the bore 14 to and through the slot 78 into the passageways 74 and 76 in the head assembly defined by the chamfered edges 70 and the diametric grooves 72, 72. This flow unseats the ball check 66 in first check valve 32 and allows working fluid to flow through the first check valve and into the first chamber 80, which increases in size as the size of the second chamber 82 decreases. When the door opening angle approaches approximately 70 degrees the piston 20 is in its broken line position of FIG. 2. At this point the finished cylindrical end portion 46 passes the relieved portion 96 and enters a substantially complementary cylindrical part of the bore 14 to substantially cut- off flow of working fluid through the relieved portion 96. However, the dimensional tolerance between the finished rear portion 46 and the portion of the bore 14 which complements it is such that slow fluid leakage occurs therebetween. This slow leakage increases resistence to further opening movement of the door resulting in a desired cushioning effect during final door opening movement.

When the door is released in an open position, initial biasing force exerted upon the piston by the compressed springs 28 and 30 causes the ball check 66 in the first check valve to seat on is associated seating surface 64 to block fluid flow through the piston head from the first chamber 80 to the second chamber 82. The force of the piston acting upon working fluid in the first chamber 80 causes fluid flow from the latter chamber through the passageways 90 and 92, and past the control or regulating valve 84 which is adjusted to allow the door to close at a desired rate in response to biasing force exerted by the springs 28 and 30. The advancing movement of the piston assembly 20 toward its closed position ultimately cuts off fluid flow through the passageway 90. However, fluid continues to flow through the passageway 92 and past the regulating valve. When the piston reaches the latter position most of the energy stored within the springs 28 and 30 is spent. However, the regulating valve 84 is adjusted so that the speed of piston travel increases to effect door latching, as required, during the final portion of piston travel in closing direction, and in a manner well known in the door closer art.

We claim:

1. In a door closer having a housing including a cylindrical bore containing a quantity or working fluid, a piston supported in the bore for reciprocal sliding movement in door opening and closing directions corresponding, respectively, to opening and closing movements of an associated door, said bore cooperating with said piston to define first and second working chambers at opposite sides of said piston, biasing means for urging the piston in the closing direction, means for moving the piston in the opening direction in opposition to biasing force exerted by the biasing means, and fluid control means for checking movement of the piston during at least a portion of its travel in either direction and including first and second check valves carried by the piston, the improvement wherein said piston comprises a piston assembly having a tubular body and a head assembly mounted in one end of said tubular body and formed from two separate and distinct head sections, said first check valve associated with one of said sections, said second check valve associated with the other of said sections, said two head sections cooperating in assembly with each other within said body to define an annular passageway opening outwardly through said head assembly and extending substantially about the periphery of said cooperating head sections and another passageway communicating with said annular passageway and said first and second check valves, said annular passageway and said another passageway forming a part of said fluid control means and defining portions of paths through said piston assembly for the flow of working fluid through said piston between said working chambers.

2. In a door closer as set forth in claim 1 wherein said another passageway comprises a radial passageway.

3. In a door closer as set forth in claim 1 the further improvement comprising a further passageway opening outwardly through said tubular body and communicating with said annular passageway.

4. In a door closer as set forth in claim 1 wherein said tubular body piston has finished cylindrical portions proximate its opposite ends for complimentary sliding engagement with the wall of said bore and an intermediate cylindrical portion of reduced diameter between said finished end portions.

5. In a door closer as set forth in claim 1 the further improvement wherein said second check valve is maintained in said closed position by the pressure of working fluid in said second working chamber and working fluid flows from said second working chamber through said piston head assembly and said first check valve to said first working chamber in response to movement of said piston assembly in said door opening direction.

6. In a door closer as set forth in claim 5 the further improvement wherein said first check valve is maintained in closed position by the pressure of fluid in said first working chamber to prevent the flow of working fluid through said piston head assembly in response to movement of said piston assembly in said door closing direction.

7. In a door closer assembly in accordance with claim 1 wherein said annular passageway is formed by opposed chamfered edges formed about the peripheral edge of each head section.

8. In a door closer having a housing including a cylindrical bore containing a quantity of working fluid, a piston assembly contained within the housing and including a piston supported in the bore for reciprocal sliding movement in door opening and closing directions corresponding respectively to opening and closing movements of an associated door, said bore cooperating with said piston to define first and second working chambers at opposite sides of said piston, a rack associated with the piston, and first and second check valves carried by the piston, spring biasing means for urging the piston in said closing direction within the bore, a spindle journalled in the housing for rotation in one and an opposite direction and projecting therefrom, a pinion on the spindle in meshing engagement with the rack for moving the piston in said opening direction in opposition to biasing force exerted by the spring means and in response to rotation of the spindle in one direction and for rotating the spindle in the opposite direction in response to movement of the piston in said closing direction, and fluid control means for checking movement of the piston during at least a portion of its travel in either direction and including said first and second check valves, the improvement wherein the piston has a tubular body and separate head assembly mounted in one end of said body and formed from separate substantially identical half-sections, said first check valve associated with one of said half-sections, said second check valve associated with each other within said body to define an annular passageway opening outwardly through said head assembly and extending substantially about the periphery of said cooperating half-sections and another passageway communicating with said annular passageway and said first and second check valves, said annular passageway and said another passageway forming a part of said fluid control means and defining portions of paths through said piston assembly for the flow of working fluid through said piston assembly between said chambers.

9. In a door closer as set forth in claim 8 the further improvement comprising means defining a further passageway communicating with said annular passageway and extending through and opening radially outwardly of said piston body.

10. In a door closer as set forth in claim 9 the further improvement wherein said piston has finished cylindrical portions proximate its opposite ends for complimentary sliding engagement with the wall of said bore and an intermediate cylindrical portion of reduced diameter between said finished end portions and said further passageway communicates with said intemediate portion.

11. In a door closer as set forth in claim 10 the further improvement wherein said second check valve is maintained in its closed position by the pressure of working fluid in said second working chamber and working fluid flows from said second working chamber through said passageway defining means and through said piston head and said first check valve to said first working chamber in response to movement of said piston in said door opening direction.

12. In a door closer as set forth in claim 11 the further improvement wherein said first check valve is maintained in closed position by the pressure of fluid in said first working chamber to prevent the flow of working fluid through said piston head in response to movement of said piston in said door closing direction.

13. In a door closer in accordance with claim 8 wherein said annular passagway is formed by opposed chamfered edges formed about the peripheral edge of each half-section.

14. In a door closer having a housing including a cylindrical bore containing a quantity of working fluid, a piston supported in the bore for reciprocal sliding movement in door opening and closing directions corresponding, respectively, to opening and closing movements of an associated door, said bore cooperating with said piston to define first and second working chambers at opposite sides of said piston, biasing means for urging the piston in said closing direction, means for moving the piston in said opening direction in opposition to biasing force exerted by the biasing means, and fluid control means for checking movement of the piston during at least a portion of its travel in either direction and including, first and second check valves carried by the pistion, the improvement wherein said piston has a tubular body and a separate head assembly proximate one end of said body formed from separate substantially identical half-sections and said first check valve is carried by one of said half-sections and second check valve is carried by the other of said half-sections, said half-sections cooperating in assembly in back-to-back relation to each other and within said tubular body to define fluid passageway means communicating with said first and second check valves and including an annular passageway opening radially outwardly through the peripheral edge of said head assembly and extending substantially about the periphery of said cooperating half-sections and another passageway communicating with said annular passageway and with said first and second check valves, said fluid passageway means forming a part of said fluid control means.

15. In a door closer as set forth in claim 14, the further improvement wherein said another passageway comprises a radial passageway.

16. In a door closer in accordance with claim 14 wherein said annular passageway is formed by opposed chamfered edges formed about the peripheral edge of each half-section.

* * * * *